US006435385B1

(12) United States Patent
Marukawa et al.

(10) Patent No.: US 6,435,385 B1
(45) Date of Patent: Aug. 20, 2002

(54) IMMERSION NOZZLE

(76) Inventors: Katsukiyo Marukawa, 1379-28, Tsuji, Itakomachi, Name kata-gun, Ibaraki 311-2421; Shigeta Hara, 37-25, Nanpeidai 4-chrome, Takatsuki-shi, Osaka 569-1042; Shinichiro Yokoya, 2-16, Midoridai, 1-chrome, Satte-shi, Saitama 340-0151, all of (JP)

( * ) Notice: Subject to any disclaimer, the term of this patent is extended or adjusted under 35 U.S.C. 154(b) by 0 days.

(21) Appl. No.: 09/509,124

(22) PCT Filed: Sep. 18, 1998

(86) PCT No.: PCT/JP98/04205

§ 371 (c)(1),
(2), (4) Date: Mar. 21, 2000

(87) PCT Pub. No.: WO99/15291

PCT Pub. Date: Apr. 1, 1999

(30) Foreign Application Priority Data

| | | |
|---|---|---|
| Sep. 22, 1997 | (JP) | 9-275029 |
| Sep. 22, 1997 | (JP) | 9-275030 |
| Sep. 22, 1997 | (JP) | 9-275031 |
| May 8, 1998 | (JP) | 10-142377 |
| May 8, 1998 | (JP) | 10-142378 |

(51) Int. Cl.[7] ..... B22D 41/08
(52) U.S. Cl. ..... 222/594; 222/606
(58) Field of Search ..... 222/594, 606; 164/437

(56) References Cited

FOREIGN PATENT DOCUMENTS

| | | | |
|---|---|---|---|
| JP | 63-108966 | * | 5/1988 |
| JP | 402041747 A | * | 2/1990 |
| JP | 07303949 A | * | 11/1995 |

* cited by examiner

*Primary Examiner*—Scott Kastler
(74) *Attorney, Agent, or Firm*—Koda & Androlia

(57) ABSTRACT

An immersion nozzle which comprises a twisted tape-shaped part (1) for allowing a flow of molten steel to swirl in the nozzle. This part is applicable to both of straight pipe type and double port type immersion nozzles, and a double port type immersion nozzle (12) is constructed to be bottomless to eliminate a problem associated with inclusions that may attached to bottom surface. Further, in the immersion nozzle, an inner wall surface of a discharge port is shaped to be arcuately divergent in longitudinal cross section, whereby the quality of cast pieces are further enhanced. When the immersion nozzle additionally includes a construction (15) for blowing a gas into a flow of molten steel which is made by the twisted tape-shaped part to swirl, effects of catching, carrying and floating inclusions are further enhanced.

8 Claims, 6 Drawing Sheets

IMMERSION NOZZLE

TECHNICAL FIELD

The present invention relates to an immersion nozzle used in continuous casting of molten steel.

BACKGROUND OF ART

In regard to an immersion nozzle used in continuous casting, in the case of billet casting, a straight type immersion nozzle is frequently used to avoid discharged molten steel from colliding with a mold wall at high speed since a distance between a nozzle and the mold wall is short. Further, in the case of slab continuous casting, a bifurcated nozzle having outlet on the narrow side of a mold is used.

In the case of a straight type immersion nozzle, molten steel is discharged mainly in the right downward direction and inclusions and bubbles are accompanied deeply in the mold and therefore, there poses a problem in which inclusions and bubbles are caught in cast steel or liable to deposit on the bent portion at the lower side of the mold to cause a defect. Further, discharged molten steel is mainly directed downward and therefore, temperature drop of molten steel at the meniscus is significant, melting of mold powder becomes insufficient and lubricity between the mold and a solidified shell is deteriorated to thereby cause surface defect of cast steel. In this specification, the meniscus is referred to an interface between molten steel and mold powder in the mold.

Meanwhile, in the case of a bifurcated immersion nozzle, discharged molten steel reaches the narrow side of the mold and thereafter turned back to the nozzle and when an outflow and the turned flow collide with each other, the meniscus is significantly fluctuated and inclusions and bubbles are trapped in cast steel. Further, also in this type of nozzle, there poses a problem in which inclusions and bubbles are deeply accompanied and trapped in cast steel or are deposited on the bent portion at the lower side of the mold. In the case of this type of nozzle, molten steel is discharged from a lower end of an outlet with a particularly high velocity and these problems become further significant in high speed casting since a maximum outlet velocity of molten steel is high. Further, the problem of temperature drop of molten steel at the meniscus is similar to the above-described.

To solve these problems, electromagnetic stirring of molten steel by a magnetic field system has been proposed for the purpose of controlling molten steel flow in the mold. Although controlling of the molten steel flow by electromagnetic stirring is effective, this process cannot be regarded as sufficient countermeasure for high speed continuous casting requested recently. Further, the electromagnetic stirrer is very expensive and the location of installing the system is disposed in a severe environment exposed to high temperature and maintenance and repair of the system is not easy.

In addition to the above-described, as a conventional problem of an immersion nozzle, there causes clogging of the nozzle owing to adhesion of inclusions. This is a problem in which nonmetallic inclusions in molten steel gradually adhere to and deposit on an inner wall of the nozzle, the nozzle finally clogs and cannot be used. Further, even when the clogging is not completed, there is a case in which adhered inclusions is peeled off and trapped into molten steel to thereby causing defect of cast steel.

As a countermeasure against adhesion of inclusions on the inner wall of the nozzle, there has been carried out a method in which inert gas is blown from the inner wall of the nozzle, inclusions in steel are trapped and taken out and are floated up in the mold. However, the method is not regarded as sufficient countermeasure since there is a case in which inclusions gradually adhere onto the inner wall in a sequential continuous casting process, to finally result in clogging of nozzle.

In respect of the problems in the conventional technology mentioned above, there has been requested an immersion nozzle capable of preventing defect factor of cast steel in the mold and preventing adhesion of inclusions on the inner wall of a nozzle to meet request for high quality cast steel and high speed casting.

DISCLOSURE OF THE INVENTION

The inventors have carried out various investigation to provide an immersion nozzle to solve the problems of the conventional technology mentioned above and conceived to provide swirlling to molten steel flow in an immersion nozzle and carried out water model experiments. As a result, it has been found by providing swirling to water flow in a nozzle that an outlet pattern can preferably be controlled such as a reduction in a maximum outlet velocity, uniform discharge from a total of an outlet and this result has been presented (Iron & Steel VoL.80 No.10 P754–758(1994), ISIJ (The Iron and Steel Institute of Japan) International VoL.34 No.11 P883–888(1994)).

In the water model experiment, swirling is provided by installing a swirling blade at an upper portion of the nozzle. A used swirling blade is constituted of a circular disc in a doughnut-like shape having an inner diameter the same as the inner diameter of the nozzle and is provided with 12 of blades each having slope for constituting a swirling flow from water flowed into the nozzle.

The inventors have groped various methods of providing swirling to actual molten steel flow. The shape of a swirling blade used in the water model experiment is complicated, manufacture by a material capable of withstanding molten steel at high temperature has been extremely difficult and the material cannot withstand physical impact of molten steel flow.

Further, a consideration has been given to the fact that swirling motion is provided to molten steel flow in the nozzle by a magnetic field system used in controlling flow of molten steel in the mold. However, it has been impossible to provide swirling to obtain an outflow pattern as in the result of the water model experiment in a short period of time during which molten steel passes in a immersion nozzle.

After all, the inventors have conceived an element which is constructed in a twisted-tape shape which has a simple shape such that it can be manufactured by a material withstanding molten steel flow and which can provide sufficient swirling. With this shape, the element can be manufactured easily and withstand impact of molten steel, further, more or less additional processing after producing and installation thereof in a nozzle are facilitated. Further, the inventors have found that excellent swirling can be provided to molten steel flow in the nozzle by properly setting the twisted-tape shape and completed the present invention.

The present invention is constituted by an immersion nozzle having an element in a twisted-tape shape to provide swirling in molten steel flow in the nozzle. When swirling is provided to molten steel flow in the nozzle by the element in a twisted-tape shape, the molten steel flow in the mold is controlled, a distance of invasion of inclusions and bubbles becomes short and trapping thereof in cast steel is prevented. Further, an effect of preventing inclusions from adhering to an inner wall of the nozzle is also achieved.

According to the present invention, excellent swirling is provided by constituting the shape of the element in a twisted-tape shape such that a ratio L/D of length L and width D falls in a range of 0.5 through 2 and a twisted angle θ is 100° or more.

The element in a twisted-tape shape of this invention is applicable to an immersion nozzle of both a straight type and a bifurcated type.

In the case of a straight type immersion nozzle of the present invention, discharge of molten steel is not directed to right downward but mainly in a skew downward direction by which invasion of inclusions and bubbles can be reduced.

Further, when at an outlet of molten steel, an inner wall thereof constitutes a figure of a divergent arc in the vertical section, molten steel flow can preferably be provided in the direction of the meniscus and lowering of temperature of molten steel at the meniscus can be reduced. The effect is further significant when the inner wall of the vertical section constitutes a figure of a divergent arc with a radius of curvature in a range of 30 through 300 mm.

Meanwhile, in the case of the bifurcated immersion nozzle of this invention, the maximum outlet velocity of molten steel can be reduced and therefore, collision of an outflow and a turned flow from the narrow side of the mold is alleviated and meniscus fluctuation can be prevented.

Further, also in the case of the bifurcated immersion nozzle, by constituting an inner wall of a nozzle reaching an outlet in a figure of a divergent arc in respect of the vertical section, molten steel flow in the mold can further preferably be controlled and the temperature drop of molten steel of the meniscus can be reduced. The effect becomes further significant when the inner wall of the vertical section is constituted by a figure of a divergent arc with a radius of curvature in a range of 30 through 300 mm.

According to the present invention, a structure without bottom can be constituted in the bifurcated nozzle which is further preferable in view of preventing adhesion of inclusions.

Further, other embodiment of the present invention is an immersion nozzle having a structure of blowing gas into molten steel flow provided with swirling in the nozzle according to each type of the nozzles mentioned above. According to the gas blowing type immersion nozzle, an effect of trapping and taking out inclusions in molten steel and floating it up in a mold is substantially prolonged.

BEST MODE FOR CARRYING OUT THE INVENTION

An explanation will be given of the present invention in further details in reference to the attached figures.

Figure 1:
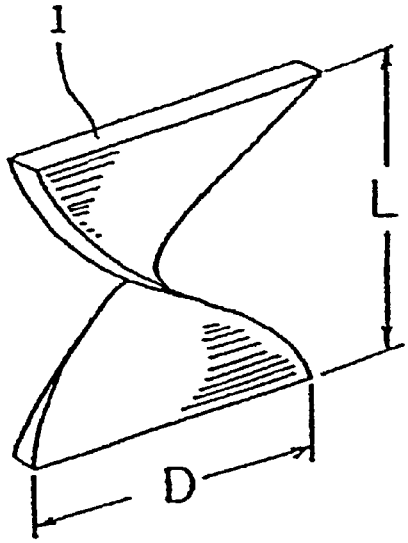
FIG. 1 is a perspective view showing an example of .an element in a twisted-tape shape
Figure 2A:
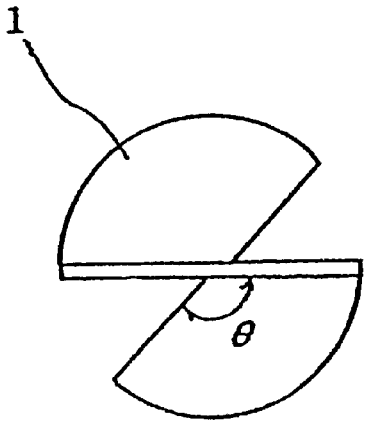
FIG. 2 shows views indicating an example of a twisted angle θ=135° of an element in a twisted-tape shape in which FIG. 2(*a*) is a plane view and FIG. 2(*b*) is a side view.
Figure 2B:
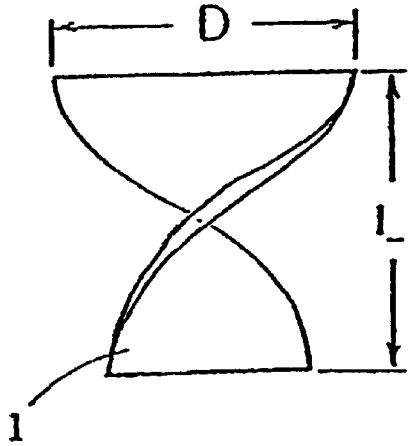

FIG. 1 shows an element 1 in a twisted-tape shape for providing swirling to molten steel flow in a nozzle which is the most important feature of the present invention The width D of the element 1 is determined by an winner diameter of the nozzle and the length L and the twisted angle θ of the element 1 may be set in a range by which sufficient swirling is provided to molten steel flow to achieve the effect of the present invention. The twisted angle θ is an angle which is produced by twisting an article in a plane tape shape. FIG. 2 shows an example of θ=135° in which FIG. 2(*a*) is a plane view and FIG. 2(*b*) is a side view.

An investigation has been carried out by the water model experiments in respect of a swirling flow when the shape of element in a twisted-tape shape is varied. The result is shown in Table 1 and Table 2. Table 1 shows a case in which the width D and the twisted angle θ of the element in a twisted-tape shape are made constant and the length L is varied and Table 2 shows a case in which the width D and the length L are made constant and the twisted angle θ is varied. No. 4 of Table 1 and No. 10 of Table 2 are the same as each other. In respect of the maximum outlet velocity, f low rates at central upper and lower portion of an outlet are measured and a maximum flow rate value of each sample is designated by an index with that of No. 1 as 100. Further, a straight type nozzle is used in the water model experiment.

TABLE 1

| | No. | | | | | | |
|---|---|---|---|---|---|---|---|
| | 1 | 2 | 3 | 4 | 5 | 6 | 7 |
| Shape of twisted-tape shape element | | | | | | | |
| width D (mm) | | 40 | 40 | 40 | 40 | 40 | 40 |
| length L (mm) | | 12 | 20 | 40 | 60 | 80 | 100 |
| L/D | | 0.3 | 0.5 | 1.0 | 1.5 | 2.0 | 2.5 |
| twisted angle θ (°) | | 180 | 180 | 180 | 180 | 180 | 180 |
| Generation of swirling flow | none | Δ | ○ | ◎ | ◎ | ○ | Δ |
| Outflow angle(°) | 0 | 10 | 40 | 45 | 45 | 40 | 10 |
| Index of maximum outlet velocity | 100 | 80 | 42 | 25 | 30 | 36 | 78 |

Remarks)
No. 1 is not provided with the element in a twisted-tape shape.
Generation of swirling flow
◎: water in pipe is flowed by being swirled uniformly
○: water is flowed by being swirled substantially uniformly although disturbance is caused partially
Δ: water is flowed while causing almost no swirling
Outflow angle : Angle of outflow water. Right downward direction is set to 0°.
Index of maximum outlet velocity : Index with that of No. 1 as 100

The flow rate is measured by a laser doppler velocimeter.

TABLE 2

| No. | 8 | 9 | 10 | 11 | 12 | 13 |
|---|---|---|---|---|---|---|
| Shape of twisted-tape shape element | | | | | | |
| width D (mm) | 40 | 40 | 40 | 40 | 40 | 40 |
| length L (mm) | 40 | 40 | 40 | 40 | 40 | 40 |
| L/D | 1.0 | 1.0 | 1.0 | 1.0 | 1.0 | 1.0 |
| twisted angle θ (°) | 90 | 120 | 180 | 200 | 240 | 270 |
| Generation of swirling flow | Δ | ○ | ◎ | ◎ | ◎ | ◎ |
| Outflow angle (°) | 5 | 40 | 45 | 45 | 45 | 45 |
| Index of maximum outlet velocity | 86 | 36 | 25 | 25 | 25 | 25 |

From the result of the water model experiment, the following is concluded. In respect of the length L and the width D of the element in a twisted-tape shape, it is preferable that the ratio L/D falls in a range of 0.5 through 2.0, particularly preferably, 0.8 through 1.5. When L/D is less than 0.5, flow of molten steel in the nozzle is considerably hindered and when L/D exceeds 2.0, sufficient swirling cannot be provided. When L/D falls in a range of 0.5 through 2.0, an effect of reducing the maximum outlet velocity is significant.

The twisted angle θ is preferable at 100° or more, particularly preferable at 120° or more. Even when θ exceeds 180°, the effect of providing swirling, the outflow angle and the maximum outlet velocity stay substantially equivalent. It is preferable that θ is 180° or less in consideration of easiness in manufacturing the element. When an angle more than 180° is needed,it is preferable to obtain the necessary angle by installing two pieces or more of the elements, although the necessary angle may be obtained by one piece of the element. Material of the element in a twisted-tape shape is not particularly limited so far as the shape can be fabricated and the material can withstand molten steel flow ,so that the material may be such that generally used in the main body of a nozzle or may be other refractory material.

Figure 3:
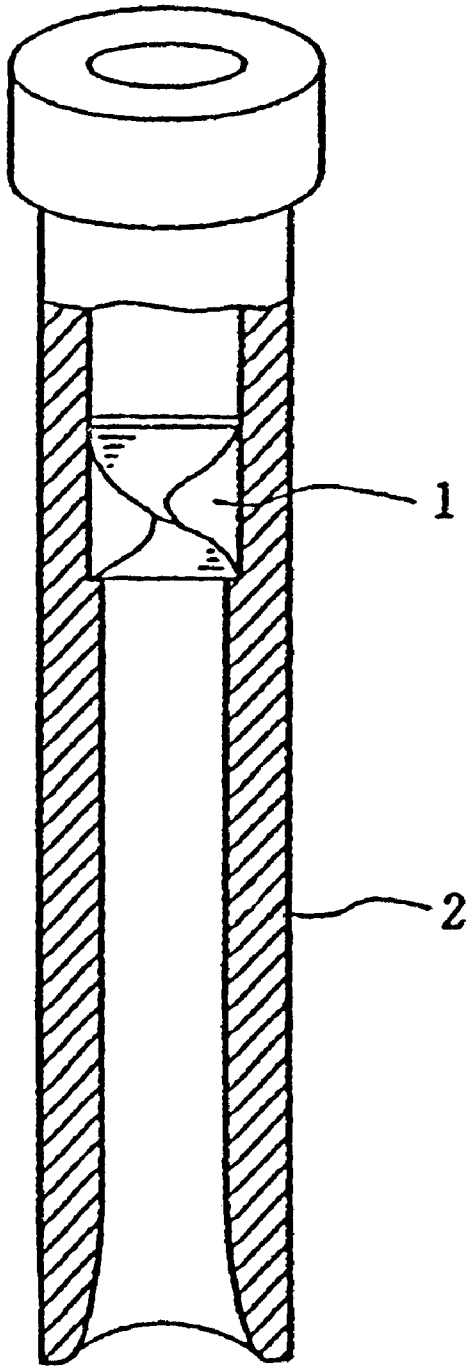
FIG. 3 is a partially broken perspective view showing an example of a straight type immersion nozzle according to the present invention.
Figure 4:
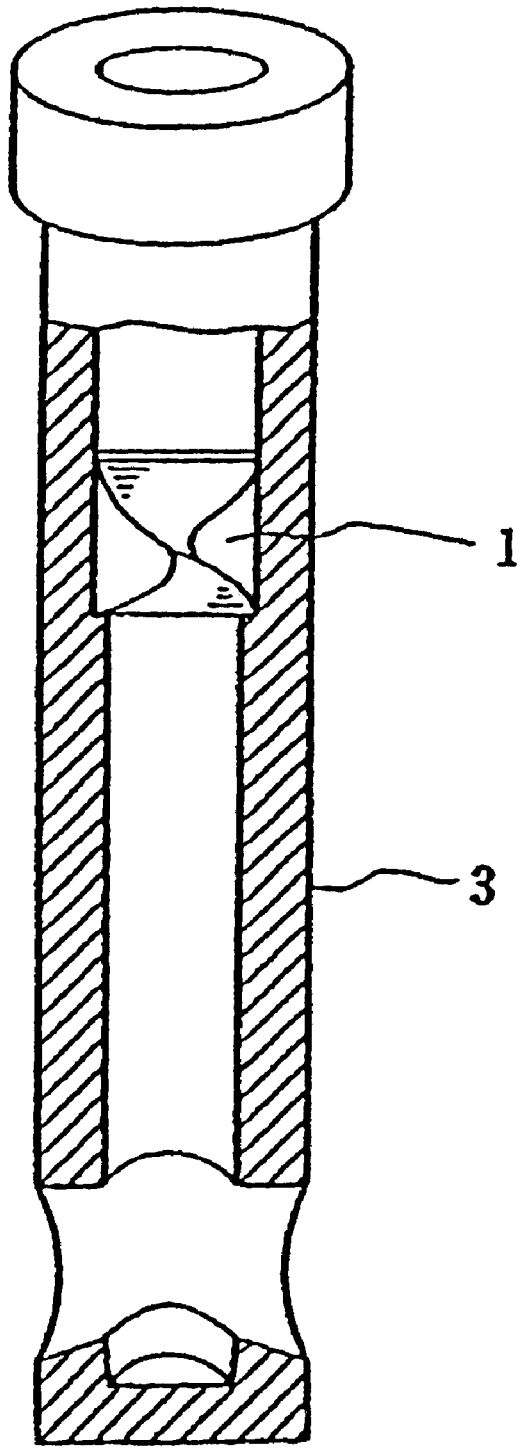
FIG. 4 is a partially broken perspective view showing an example of a bifurcated immersion nozzle according to the present invention and FIG. 5 is a sectional view showing an example of an immersion nozzle according to the present invention in which an inner wall of an outlet of molten steel constitutes a figure of a divergent arc in the vertical section.

The immersion nozzle having the element in a twisted-tape shape according to the present invention can preferably be used in any of a straight type nozzle and a bifurcated nozzle. Examples of the immersion nozzles are respectively shown in FIG. 3 and FIG. 4.

Figure 5:
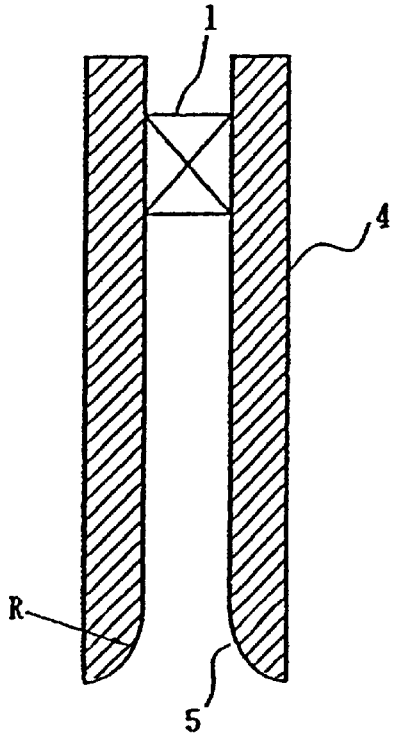
Figure 6:
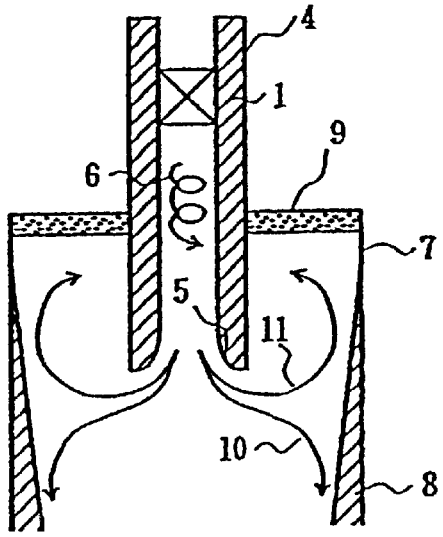
FIG. 6 is a schematic view indicating molten steel flow when the immersion nozzle as shown in FIG. 5 is used and FIG. 7 shows views indicating an example of an immersion nozzle according to the present invention of a bifurcated type with a structure without bottom which is an immersion nozzle in which an inner wall near an outlet constitutes a figure of a divergent arc in the vertical section in which FIG. 7(*a*) is a perspective view and FIG. 7(*b*) is a sectional view.

Describing a straight type immersion nozzle 2, by providing swirling to molten steel flow in the nozzle 2, the maximum outlet velocity in discharging molten steel from the nozzle 2 can considerably be reduced and a falling flow 10 from the nozzle 2 is directed in a skew direction of about 45° as shown in FIG. 6. As a result, the distance of accompanying of inclusions and bubbles present in the discharged molten steel can be restrained shallow and therefore, trapping of inclusions and bubbles into cast steel and deposition thereof on a bent portion at the lower side of a mold 7 are prevented. Further, by providing swirling 6 to molten steel in a nozzle 4, adhesion of inclusions onto an inner wall of the nozzle 4 is prevented. Moreover, by discharging molten steel flow in the mold 7 provided with the swirling 6 in the nozzle 4, molten steel in the mold 7 is preferably stirred and therefore, there is achieved an effect in which quality of cast steel becomes uniform. In this respect, as shown in FIG. 5, by constituting an inner wall of the nozzle 4 at an outlet 5 of molten steel in a shape of a divergent arc in the vertical section,there is achieved higher quality cast steel. The effect is particularly achieved when a radius R of curvature in a circular arc shape of the inner wall of the outlet 5 is 30 through 300 mm. When R is less than 30 mm, a portion of an inner wall in a circular arc shape is short and occurrence of a upward flow becomes insufficient when molten steel is discharged and when R exceeds 300 mm, the shape is near to a divergent linear shape and discharge toward a skew downward direction is mainly caused and occurrence of a upward flow is also becomes insufficient.

Figure 9:
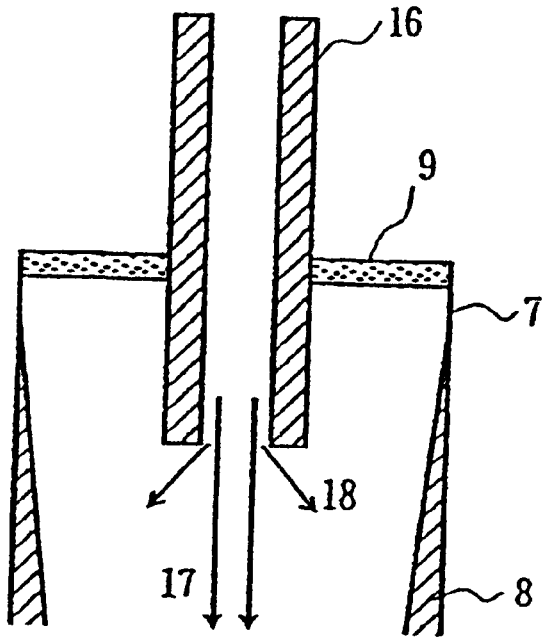

By a combination effect of providing swirling to molten steel flow and proper selection of the shape of the outlet of the nozzle, both of inner defect and surface defect of cast steel are considerably reduced compared with using a conventional nozzle. In this respect, an explanation will be given in reference to FIG. 6. When the outlet 5 of the nozzle 4 is formed in the above-described shape, in the molten steel flow provided with the swirling 6 in the nozzle 4, in addition to a downward flow 10 in the skew direction of about 45° in a mold 7, a upward flow 11 progressing toward the meniscus is also caused and accordingly, the stirring of molten steel is preferably caused at the meniscus. As a result, temperature drop of molten steel at the meniscus is reduced and the molten state of a mold powder 9 is appropriately maintained and therefore, lubrication between the mold 7 and the solidified shell 8 is excellently maintained by which surface defects of cast steel are reduced. This effect is apparent by comparing with a conventional straight type immersion nozzle 16 shown in FIG. 9. That is, in FIG. 9, molten steel flow is mainly constituted by a flow 17 in the right downward direction and a flow 18 in a slightly skew downward direction is observed.

A description will be given of a case in which the present invention is applied to a bifurcated immersion nozzle 3. In the conventional nozzle, the outlet velocity is extremely high at a lower portion of the outlet and outlet velocity at a central portion or an upper portion thereof is small. However, by providing swirling to molten steel in the nozzle, molten steel is discharged from any of the central portion, the upper portion and the lower portion of the outlet substantially at a uniform velocity and the maximum outlet velocity is considerably reduced. For example, in No. 4 of Table 1, compared with No. 1, the maximum outlet velocity is reduced to ¼. Therefore, collision of an outflow and a turned flow from the narrow side of the mold becomes extremely mild and the meniscus fluctuation is restrained. Further, the distance of accompanying of inclusions and bubbles becomes short and accordingly, trapping thereof into cast steel and deposition of inclusions at a bent portion at the lower side of the mold are reduced. By such an effect, defects of cast steel are reduced to high quality Further, by providing swirling to molten steel flow in the nozzle, an effect of reducing inclusions from adhering to an inner wall of the nozzle is also achieved. In the conventional bifurcated immersion nozzle, adhesion of inclusions is significant at a bottom of the nozzle. According to the immersion nozzle 3 of the present invention, as mentioned above, swirling is provided to molten steel flow and therefore, molten steel is discharged at a substantially uniform velocity at any portions of the outlet. Therefore, even when a structure without bottom of the nozzle is constituted, discharging in the right downward direction is slight and molten steel is discharged mainly in a skew direction of about 45°. As a result, not only the effect of reducing short the distance of invasion of inclusions and bubbles is maintained but also the problem of adhesion of inclusions onto the bottom is resolved by the structure without bottom and life of the nozzle is prolonged. In addition, there is also an advantage of manufacturing.

Figure 7A:
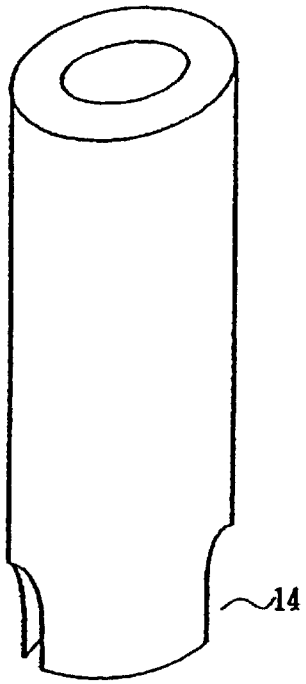
Figure 7B:
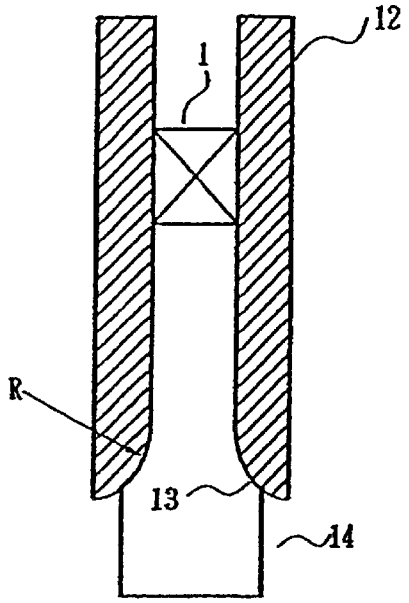

Further, similar to the straight type nozzle,by the effect of stirring molten steel in the mold by discharging molten steel flow provided with swirling, high quality cast steel is achieved. Also in the bifurcated immersion nozzle, by constituting the inner wall near the outlet in a divergent arc shape in the vertical section, in addition to a downward flow in skew direction of 45°, an upward flow progressing toward the meniscus is also caused. As a result, the effect of reducing temperature drop of molten steel at the meniscus, described in respect of the straight type nozzle, can similarly be achieved and surface defects of cast steel are reduced. The effect is particularly significant when a radius R of curvature of a circular arc shape at the inner wall of the nozzle near the outlet is 30 through 300 mm. When the radius R of curvature is less than 30 mm, a portion of the inner wall in a circular arc shape is short and therefore, the upward flow becomes insufficient and on the contrary the radius R exceeds 300 mm, the shape is near to a linear divergent shape,the discharge is mainly directed in skew downward direction and accordingly, the upward flow also becomes insufficient. When a structure without bottom is constructed in a bifurcated immersion nozzle 12, although an outlet 14 is formed in a hollowed shape as shown in FIG. 7(*a*), an inner wall 13 near the hollowed portion may be formed in the divergent arc shape.

According to the immersion nozzle of the present invention, by providing swirling to molten steel flow in the nozzle, the effect of reducing adhesion of inclusions on the inner wall of the nozzle is achieved and the effect of preventing adhesion of inclusions becomes further significant by blowing inert gas or the like to molten steel provided with swirling.

molten steel flow in the mold, however, the invention does not exclude using of an electromagnetic stirrer together with.

Embodiments

Specific examples of the present invention will be shown in respect of various immersion nozzles as follows.

Nozzles shown in Table 3 as straight type immersion nozzles are tested. The used immersion nozzles are made of alumina-graphite material and samples having an outer diameter of 105 mm, an inner diameter of 60 mm and a length of 700 mm are molded by a cold isostatic press and in respect of samples other than those of Embodiment 1 and Comparative example 1, the inner wall of the outlet in each thereof is manufactured in a diverging shape. An element in a twisted-tape shape is constituted by a sintered boron nitride, a step is formed on the inner wall of the nozzle in shaping the nozzle and the previously manufactured element is installed to be caught by the step. For the type A of the element, both the length L and the width D are 60 mm with L/D=1 and the twisted angle is θ=180°. With respect to type B, the length is L=48 mm, the width is D=60 mm with L/D=0.8 and the twisted angle is θ=140°. In both types, the thickness of the element is 10 mm.

TABLE 3

| | Embodiments | | | | | | Comparative examples | |
|---|---|---|---|---|---|---|---|---|
| | 1 | 2 | 3 | 4 | 5 | 6 | 1 | 2 |
| Type of twisted-tape element | A | A | A | A | A | B | None | None |
| Radius of curvature of inner wall of outlet (mm) | | 50 | 150 | 250 | 350 | 150 | | 150 |
| Inner defect index | 0.40 | 0.15 | 0.15 | 0.15 | 0.15 | 0.15 | 1.00 | 0.95 |
| Surface defect index | 0.50 | 0.10 | 0.08 | 0.15 | 0.40 | 0.08 | 1.00 | 0.08 |
| Temperature difference of molten steel between in the tundish and meniscus (° C.) | 20 | 13 | 9 | 12 | 16 | 10 | 25 | 23 |

Remark)
The inner wall of the outlet is not formed in a divergent shape in Embodiment 1 and Comparative example 1.

Figure 8:
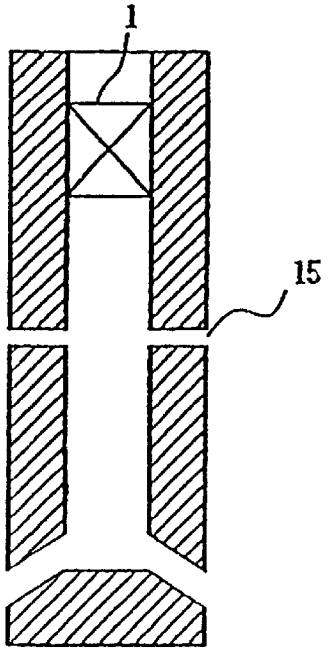
FIG. 8 is a sectional view showing an example of an immersion nozzle according to the present invention having a structure of blowing gas and FIG. 9 is a schematic view showing molten steel flow when a conventional straight type immersion nozzle is used.

In the conventional gas blowing type nozzle, the blown gas is simply moved along with molten steel and takes out inclusions which is brought into contact with the gas. According to the immersion nozzle of the present invention, the blown gas is converged on the axial direction of the nozzle since the molten steel flow swirls. In this case, the bubbles form a film of high density in a conical shape and accordingly, a probability of bringing bubbles into contact with inclusions in molten steel is enhanced. As a result, the inclusions are not adhered onto the inner wall of the nozzle but are trapped and taken out by bubbles and are floated up in the mold. By the effect of preventing adhesion of inclusions,the nozzle is scarce to clog and therefore, life of the nozzle is prolonged. Further, compared with conventional gas blowing, the effect is achieved by supplying gas at a low flow rate and at low pressure and therefore, it is also economical. FIG. 8 shows an example of an immersion nozzle according to the present invention having a gas blowing system 15.

The immersion nozzle according to the present invention provides swirling to molten steel flow in the nozzle by the element in a twisted-tape shape and can preferably control By using the immersion nozzles under the specification shown in Table 3, the billet of horizontal section of 170 mm×170 mm is cast at the speed of 2.5 m/min, and rates of inner defect and surface defect of cast steel are measured. Further, temperature of molten steel in the tundish and temperature of molten steel at the meniscus are measured and the temperature difference is shown in Table 3. The measurement is carried out similarly in respect of comparative examples.

In respect of inner defect, the number of defects on a surface produced by cutting a cast steel end of the billet by 40 mm is measured,and in respect of surface defect, the number of defects on a surface produced by shaving the. cast steel face by 5 mm is measured, and both are indicated by an index with that of Comparative example 1 as 1.

By installing the element in the twisted-tape shape according to the present invention, both the inner defect and the surface defect of cast steel are reduced to ½ or less. Further, by forming the inner wall of the outlet by the divergent arc shape, temperature drop of molten steel at the meniscus is reduced, further reduction is observed both in the inner and the surface defects and in case the radius of curvature is 30 through 300 mm, the defect rate is about 1/6 through 1/10 of that of Comparative example 1.

Nozzles under the specification shown in Table 4 as bifurcated immersion nozzles are tested. The main body of the nozzle is made of alumina-graphite material and samples having the inner diameter of 74 mm, the outer diameter of 130 mm and the length of 500 mm are shaped by a cold isostatic press. The element in a twisted-tape shape is manufactured by a sintered boron-nitride, a step is formed on the inner wall of the nozzle in shaping the nozzle and the element is installed to the step. For the shape, the width is D=80 mm, the length is L=80 mm (L/D=1), the twisted angle is=180°. and the thickness is 10 mm. The each immersion nozzle is installed at the bottom of a tundish having a capacity of 50 tons and Al killed steel is cast at a speed of 2 m/min. The test is similarly carried out also in respect of comparative example. The respective test results are shown in Table 4.

By installing the element in a twisted-tape shape according to the present invention, a range of velocity variation at the meniscus is reduced and as a result, f defects on the surface of cast steel are reduced to about 1/8 of that of Comparative example 3. Further, the effect of prevention of adhesion of inclusions on the inner wall of the nozzle and prevention of deposition of inclusions on the bent portion at the lower side of the mold is enormous.

TABLE 4

| | Embodiment 7 | Comparative example 3 |
|---|---|---|
| Twisted-tape element | Present | None |
| Velocity variation at meniscus (m/s) | 0.07~0.11 | 0.05~0.22 |
| Surface defect rate of cast steel (number/100 $cm^2$) | 0.06 | 0.46 |
| State of bent portion on lower side of mold after casting 1,250 tons | Almost no deposition of inclusions | Deposition of inclusions by about 1/6 of cast thickness |

Table 5 shows the test result with regard to presence or absence of a bottom of a bifurcated immersion nozzle. The material and dimensions of the nozzle of main body and the material and shape of the element in a twisted-tape shape are the same as those in Table 4. Each immersion nozzle is installed at the bottom of a tundish having a capacity of 50 tons and Al killed steel is cast. The test is similarly carried out in respect of comparative example. Table 5 shows the test results.

By installing the element in a twisted-tape shape according to the present invention, defects of cast steel are reduced, prolongation in the life of the nozzle by preventing adhesion of inclusions on the inner wall of the nozzle is observed and by constituting the structure without bottom, both the rate of surface defect and life until clogging of the nozzle are substantially prolonged. The life of the nozzle without bottom is provided with the life near to twice of that of the nozzle having the bottom and about three times of that of the nozzle without element in a twisted-tape shape.

TABLE 5

| | Embodiments | | Comparative example |
|---|---|---|---|
| | 8 | 9 | 4 |
| Bottom structure of nozzle | With bottom | Without bottom | With bottom |
| Twisted-tape element | Present | Present | None |
| Surface defect rate of cast steel (number/100 $cm^2$) | 0.06 | 0.03 | 0.25 |
| State of bent portion on lower side of mold after casting 2,000 tons | Almost no deposition of inclusions | Almost no deposition of inclusions | Deposition of inclusions by about 1/6 of cast thickness |
| State of adhering inclusions on inner wall of nozzle after casting 2,000 tons | Slight adhesion at vicinity of bottom portion | No adhesion both at straight portion & vicinity of outlet | Significant adhesion almost to nozzle clogging |
| Life index until nozzle clogging | 182 | 290 | 100 |

Table 6 shows the test result investigating on the shape of the inner wall near the outlet for bifurcated immersion nozzles. The used immersion nozzles are made of alumina-graphite material of the outer diameter of 130 mm, the inner diameter of 75 mm and the length of 700 mm, are shaped by a cold isostatic press and the outlets are made such that the inner wall near the outlet is constituted in a divergent arc shape having predetermined radius of curvature in the vertical section except those in Embodiment 10 and Comparative example 6. The element in a twisted-tape shape is manufactured by sintered boron-nitride, a step is formed on the inner wall of each of the nozzles in shaping the nozzles and a previously fabricated element is installed to the step. For the shape of the element, in type A, both the length L and the width D are 75 mm with L/D=1 and the twisted angle is θ=180°. In type B, the length is L=60 mm, the width is D=75 mm with L/D=0.8 and the twisted angle is θ=140° The thickness of all of the elements is 10 mm. By using the immersion nozzles under the specification shown in Table 6, slab is cast at the speed of 2.5 m/min. And the occurrence rates of inner defect and surface defect of cast steel are measured. Slab is cast by the mold having a horizontal section of 1200 mm×250 mm. Temperature of molten steel in the tundish and temperature of molten steel at the meniscus are measured and temperature difference is shown in Table 6. Measurement is similarly carried out in respect of comparative examples. The inner defect is measured by a number of defects on a face produced by cutting the cast steel end of the slab by 40 mm, the surface defect is measured by the number of defects on a face produced by shaving the cast steel face by 5 mm and both of them are indicated by the index with a result of Comparative example 1 as 1.

By installing the element in a twisted-tape shape according to the present invention, defects are reduced. The effect becomes further significant by constituting the inner wall near a hollowed portion for injecting molten steel in a divergent arc shape in the vertical section. In the case of a circular arc shape having the radius of curvature of 30 through 300 mm, compared with the sample in which the inner wall is not constituted by a divergent arc shape, the inner defects are reduced to about 1/3 and the surface defects are reduced to about 1/2. When the inner wall is formed in a divergent arc shape, compared also with a sample without element in a twisted-tape like shape, the inner defects are reduced to about 1/5 and the surface defects are reduced to about 1/3 through 1/4.

TABLE 6

| | Embodiments | | | | | | Comparative examples | |
|---|---|---|---|---|---|---|---|---|
| | 10 | 11 | 12 | 13 | 14 | 15 | 5 | 6 |
| Type of twisted-tape element | A | A | A | A | A | B | None | None |
| Structure of bottom of the nozzle | Without bottom | Without bottom | Without bottom | Without bottom | Without bottom | Wi-bottom | Without bottom | With-bottom |
| Radius of curvature of inner wall of outlet (mm) | | 50 | 150 | 250 | 350 | 150 | 150 | |
| Inner defect index | 0.55 | 0.20 | 0.20 | 0.20 | 0.20 | 0.30 | 1.00 | 0.85 |
| Surface defect index | 0.60 | 0.30 | 0.25 | 0.35 | 0.45 | 0.40 | 1.00 | 0.70 |
| Temperature difference of molten steel btw. in the tundish & meniscus (° C.) | 24 | 14 | 11 | 15 | 18 | 11 | 25 | 22 |

Remark)
The inner wall of the outlet is not formed in a divergent shape in Example 10 and Comparative example 6.

In order to confirm the effect of the immersion nozzle having the element in a twisted-tape shape according to the present invention and also having a gas blowing system, the sample under a specification the same as that of Embodiment 7 (Embodiment 16) and the sample provided with the gas blowing system are made (Embodiment 17). The immersion nozzles are mounted to a tundish having a capacity of 50 tons and casting is carried out blowing Ar gas. For comparison, the immersion nozzle having a specification the same as that of Comparative example 3 is similarly used (Comparative example 7).

After casting 2000 tons slight adhesion of inclusions is observed only at a vicinity of the outlet in the case of the nozzle of Embodiment 16, almost no adhesion of inclusions is observed at the straight portion and the vicinity of the outlet in the case of the nozzle of Embodiment 17, however, in the case of the immersion nozzle in Comparative example 7, slight adhesion is observed at the straight portion and significant adhesion is observed at the vicinity of the outlet port. As a result, the life of Embodiment 16 to changing the nozzle is 1.2 times as large as that of Comparative example and that of Embodiment 17 is 1.6 times as large as that of Comparative example and the effect of prolonging the life by using the gas blowing together with becomes apparent.

Industrial Applicability

The present invention is an immersion nozzle installed an element in a twisted-tape shape to provide swirlling to molten steel flow in continuous casting of molten steel, with a purpose of controlling molten steel flow and preventing adhesion of inclusions on an inner wall of an immersion nozzle in a mold in pursuit of high quality of cast steel. As a result, without using an expensive device such as an electromagnetic stirrer, an immersion nozzle capable of achieving the above-described object and contributing to high quality of cast steel and prolongation of life of the nozzle is obtained. The immersion nozzle having the element in a twisted-tape shape according to the present invention is applicable both to a straight type and a bifurcated type.

What is claimed is:

1. An immersion nozzle having an element for providing swirling to molten steel flow in the immersion nozzle, wherein the element consists of a single twisted-tape having a width D nearly equal to an inner diameter of the nozzle and said twisted-tape divides said molten steel flow into two parts at an inner diameter portion of the immersion nozzle.

2. An immersion nozzle according to claim 1, wherein the twisted-tape is constituted by a ratio L/D of a length L to the width D of 0.5 through 2 and a twisted angle θ of 100° or more.

3. An immersion nozzle according to claim 1 or 2, wherein the immersion nozzle is a straight nozzle.

4. An immersion nozzle according to claim 3, wherein the straight nozzle is formed in a divergent arc shape with a radius of curvature in a range of 30 through 300 mm in a vertical section.

5. An immersion nozzle according to claim 1 or 2, wherein the immersion nozzle is a bifurcated nozzle.

6. An immersion nozzle according to claim 5, wherein an inner wall near an outlet of molten steel of the bifurcated immersion nozzle is formed in a divergent arc shape with a radius of curvature in a range of 30 through 300 mm in a vertical section.

7. An immersion nozzle having an element for providing swirling to molten steel flow in the immersion nozzle, wherein an outlet in the immersion nozzle has a structure without a bottom with two hollowed portions in a direction to a diameter of the immersion nozzle.

8. An immersion nozzle according to claim 7 wherein said element for providing swirling to molten steel flow comprises a single twisted tape having a ratio L/D of a length L to the width D of 0.5 through 2 and a twisted angle θ of 100° or more.

* * * * *